US005975999A

United States Patent [19]

Nitta

[11] Patent Number: 5,975,999

[45] Date of Patent: Nov. 2, 1999

[54] HAND TOOL HAVING A CUSHIONED LAMINATE ATTACHMENT SURFACE

[75] Inventor: Yoshiki Nitta, Ishikawa pref., Japan

[73] Assignee: 3M Innovative Properties Company, St. Paul, Minn.

[21] Appl. No.: 09/002,585

[22] Filed: Jan. 5, 1998

[30] Foreign Application Priority Data

Jan. 6, 1997 [JP] Japan ..... 9-000288

[51] Int. Cl.[6] ..... B24B 23/00

[52] U.S. Cl. ..... 451/354; 451/491; 451/533; 451/538

[58] Field of Search ..... 451/344, 354, 451/491, 533, 530, 538, 557

[56] References Cited

U.S. PATENT DOCUMENTS

| | | | |
|---|---|---|---|
| 2,644,280 | 7/1953 | O'Neil, Jr. | 451/538 |
| 3,416,265 | 12/1968 | Marton | 451/530 X |
| 3,732,651 | 5/1973 | Rodstein | 451/344 X |
| 4,263,755 | 4/1981 | Globus | 451/538 X |
| 4,667,447 | 5/1987 | Barton | 451/533 X |
| 4,674,237 | 6/1987 | Sullivan . | |
| 5,212,910 | 5/1993 | Breivogel et al. | 451/530 |
| 5,383,309 | 1/1995 | Sampietro | 451/533 |
| 5,564,965 | 10/1996 | Tanaka et al. | 451/533 |

FOREIGN PATENT DOCUMENTS

| | | |
|---|---|---|
| 56-116155 U | of 1981 | Japan . |
| 57-13149 U | of 1982 | Japan . |
| 57-170956 U | of 1982 | Japan . |
| 61-16269 U | of 1986 | Japan . |
| 61-205753 U | of 1986 | Japan . |

OTHER PUBLICATIONS

3M Stikit™ product information (in Japanese).
3M Drywall Abrasives product information (in English).
3M Auto–Pak™ Product information (in English).

*Primary Examiner*—Timothy V. Eley
*Attorney, Agent, or Firm*—Paul W. Busse

[57] ABSTRACT

A hand tool which includes a cushion member of a construction which is capable of preventing the separation of a cushion member due to frictional heat and force generated during the grinding operation. The abrasive hand tool includes a tool body having a generally flat bearing surface and a thin sheet-like cushion member fixedly secured to the bearing surface of the tool body. The cushion member includes an inner layer fixedly bonded to the bearing surface of the tool body via an adhesive and an outer layer layered and bonded with the inner layer. The outer layer defines on the outer surface thereof a generally flat attachment surface for detachably holding an attachment means-backed abrasive sheet. The inner layer is made of a soft resinous foam, such as polyvinyl chloride resin, polyurethane resin or others. The outer layer is made of a sheet of material which is preferably the same as and harder than the inner layer, and bonded to the inner layer without using an adhesive by a fusion-bonding process such as a high frequency bonding process.

7 Claims, 2 Drawing Sheets

HAND TOOL HAVING A CUSHIONED LAMINATE ATTACHMENT SURFACE

REFERENCE TO OTHER APPLICATION

This application claims priority from Japanese Patent Application No. 9-288, filed Jan. 6, 1997.

BACKGROUND OF THE INVENTION

1. Technical Field of the Invention

The present invention relates to a hand tool for grinding the surface of an object with an abrasive sheet carried by the tool body, and particularly to a hand tool comprising a tool body including a generally flat surface and a cushion member having a first surface secured to the flat surface of the tool body and an opposite generally flat attachment surface on which an attachment means-backed (e.g., pressure-sensitive adhesive-backed) abrasive sheet may be detachably attached.

2. Description of the Related Art

Abrasive hand tools used for the grinding or surface-finishing of wooden or metallic objects are well-known in the art. Certain types of such tools generally have a small size and are of a light weight sufficient for use by a single hand of the operator, while detachably mounting thereon an abrasive sheet of a desired abrasive particle size. The abrasive sheet typically has abrasive particles on the front surface of a backing and a coating of attachment material such as pressure-sensitive adhesive capable of repeated attachment to and detachment from the tool on the back surface. An adhesive-coated abrasive sheet is preferred in view of its excellent performance with such a tool.

In general, the tool body of the abrasive hand tool of this type is formed of a relatively rigid material for the purpose of transmitting the pressure from the operator's hand to the abrasive sheet. In such a case, a structure is advantageously employed, wherein a thin sheet-like cushion member of a resinous material is permanently secured to a generally flat bearing surface of the tool body and the abrasive sheet with the pressure sensitive adhesive is detachably attached to a generally flat attachment surface of the cushion member. Such a cushion member provides a smooth surface for the abrasive sheet during grinding and reduces user fatigue.

The cushion member used in prior commercial abrasive hand tools generally consists of an inner or first layer of a foam typically permanently bonded by adhesive to the bearing surface of the tool body and a sheet-like outer or second layer bonded to the inner layer also with adhesive. The inner layer has a cushioning function for improving the surface smoothness and reducing user fatigue, and is generally made of polyurethane foam. The outer layer has an attachment surface for holding the abrasive sheet and has sufficient structural integrity to permit detachment (replacement) of the abrasive sheet without structural failure. The outer layer is generally made of a polyvinyl chloride sheet.

Since the inner and outer layers of the cushion member are typically made of different polymeric materials, they have different thermal expansion properties in use as heat is transmitted from the abrasive sheet to the cushion member during the grinding operation. As a result, the outer layer is relatively easily separated from the inner layer particularly in the peripheral area thereof, because of the frictional force encountered during the grinding operation. Such a separation is particularly noticeable when the adhesive provided between the inner and outer layers is insufficiently cured or if the adhesive tends to be softened by heat. If the abrasive sheet is attached to the cushion member in which such a separation has occurred, it becomes difficult to hold the abrasive sheet flat to provide the needed smooth grinding surface.

In addition, with the conventional abrasive hand tool, there is a risk that the frictional force and heat generated during the grinding operation may cause failure of the adhesive bond between the foam cushion member surface and the surface of the tool to which it is adhered whereby the cushion member may detach from the tool body.

Moreover, in a conventional abrasive hand tool, the pressure sensitive adhesive of the abrasive sheet coated on the attachment surface of the cushion member may be transferred to the attachment surface because of softening caused by the frictional heat during the grinding operation. If this happens, the transferred adhesive must be removed from the attachment surface when the exhausted abrasive sheet is replaced by a fresh one, in order to maintain the flatness of the attachment surface.

Accordingly, an object of the present invention is to provide a hand tool capable of reducing or preventing the separation of the outer layer from the inner layer of the cushion member which may result from the frictional heat and force generated during the grinding operation.

Another object of the present invention is to provide a hand tool capable of reducing or preventing the detaching of the cushion member from the bearing surface of the tool body which may result from the frictional heat and force generated during the grinding operation.

A further object of the present invention is to provide a hand tool capable of reducing or preventing the transfer of the pressure sensitive adhesive coated on a abrasive sheet to an attachment surface of a cushion member which may result from the frictional heat and force generated during the grinding operation.

SUMMARY OF THE INVENTION

To achieve the above objects, the present invention provides a hand tool comprising a tool body including a generally flat surface and a cushion member having a first surface secured to the flat surface of the tool body and an opposite generally flat attachment surface on which an attachment means backed abrasive sheet may be detachably attached, characterized in that the cushion member comprises a laminate of a first layer of soft material, one surface of which provides the first surface and a sheet-like second layer of a material which is harder than the soft material, one surface of which provides the attachment surface, wherein the first and second layers are fusion bonded together.

The preferred attachment means comprises a layer of pressure sensitive adhesive and the attachment surface comprises a surface to which the pressure sensitive adhesive may adhere, most preferably with the attachment surface characterized by having thereon a plurality of micro-indentations. The attachment means may alternatively comprise one part of a two part mechanical fastener sheet material and the attachment surface includes the other part of the two part mechanical fastener sheet material.

Preferably the hand tool includes a cushion member wherein the soft material and the harder material are each comprised of the same resinous material, most preferably each comprising polyvinyl chloride. Further, the preferred cushion member includes a soft material that has a Shore A hardness value in the range of 15 to 52, and a harder material that has a Shore A hardness value in the range of 42 to 85 but which is at least 20 points higher than the Shore A hardness value of the soft material.

The preferred hand tool of the invention has a tool body which includes a receptacle for accommodating a supply roll of a strip of the attachment means backed abrasive sheet, wherein the strip has a suitable segment extending from the roll over the attachment surface and is attached to the attachment surface by the attachment means.

BRIEF DESCRIPTION OF THE DRAWINGS

The various features of the invention will become apparent from the drawings and description of the preferred embodiments.

DETAILED DESCRIPTION OF THE INVENTION

The preferred embodiments of the present invention will be described in detail below with reference to the drawings.

Figure 1:
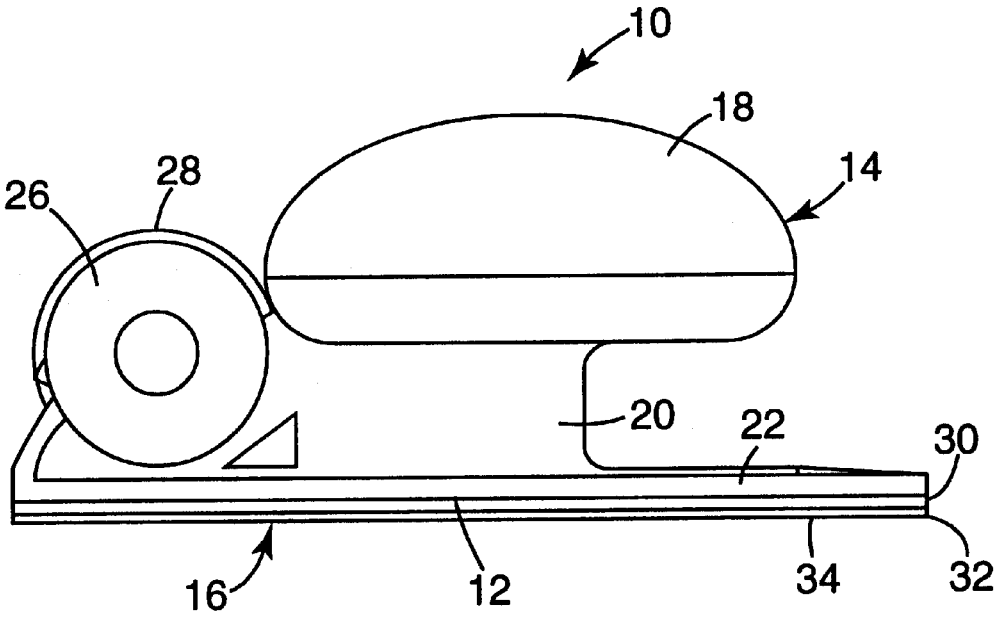
FIG. 1 is a side view of an abrasive hand tool according to one embodiment of the present invention.
Figure 2:
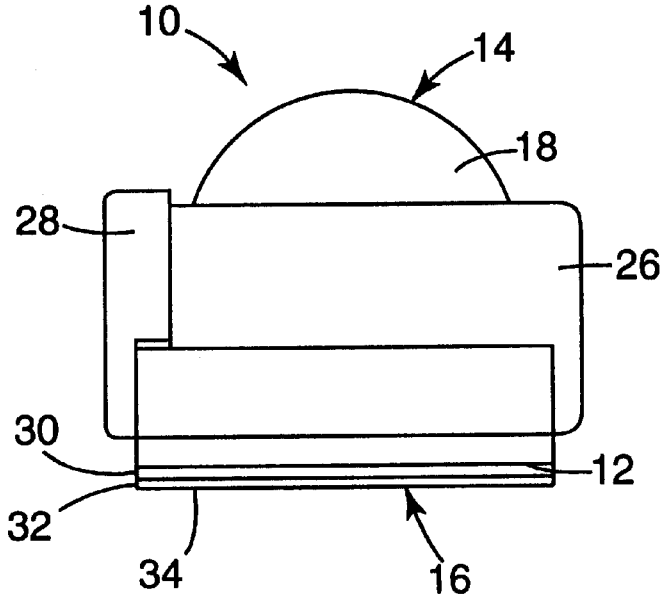
FIG. 2 is a front view of the abrasive hand tool of FIG. 1.

With reference to FIGS. 1 and 2, an abrasive hand tool 10 according to one embodiment of the present invention includes a tool body 14 having a generally flat bearing surface 12 and a cushion member 16 adhesively secured to the bearing surface 12 of the tool body 14. The tool body 14 includes a grip 18 of any shape (e.g., an oval shape) of a size to be gripped by the operator and a support portion 22 defining the bearing surface 12. In the illustrated embodiment, a receptacle 26 is provided for accommodating a supply roll (not shown) of a strip of an abrasive sheet 24 (FIG. 4) coated with a pressure sensitive adhesive (i.e., an adhesive-coated abrasive sheet 24). A closure 28 is detachably mounted to the receptacle 26 for closing an opening thereof (not shown) at one axial end.

A two-part mechanical fastening system (e.g., hook and loop mating fasteners) may take the place of the pressure-sensitive adhesive coating, in which case one part of the two-part system would be adhered to bearing surface 12 while the other part would be adhered to the backside of the abrasive strip.

Preferably, the tool body 14 has a small size and a light weight sufficient to be freely operable by a single hand of the operator, and is made of a relatively rigid and light material such as wood, plastic or light metal for the purpose of transmitting a force generated from the operator's hand to the abrasive sheet 24. The grip 18 and the support portion 22 may be formed as a one-piece body from the same material, or may be formed as separate bodies from the same or different materials. The support portion 22 preferably has a profile in a plan view corresponding to a definite size of the abrasive sheet available from the market.

Figure 3:
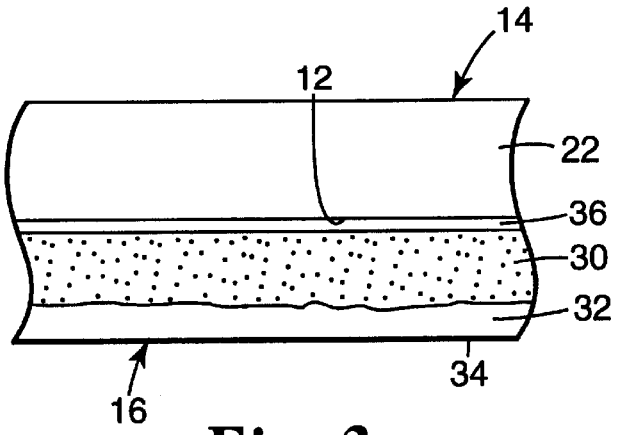
FIG. 3 is an enlarged side view of a segment of the abrasive hand tool of FIG. 1, showing detail of the cushion member.

The cushion member 16 has a function for improving the flatness of the finished surface processed by the abrasive hand tool and reducing user fatigue. As shown in FIG. 3, in an enlarged view, the cushion member 16 is composed of a laminate which includes an inner or first layer 30 permanently secured to the bearing surface 12 of the tool body 14 and an outer or second layer 32 fusion bonded to the contacting surface of inner layer 30. The outer layer 32 defines a generally flat attachment surface 34 for detachably holding the adhesive-coated abrasive sheet 24.

The inner layer 30 has a cushioning function for improving the surface flatness and reducing fatigue as described above, and is formed from a soft material of a suitable thickness. The preferred material of the inner layer 30 is a resinous foam of a polymer material such as polyvinyl chloride or polyurethane. The preferred thickness of layer 30 is about 1 to 5 mm, most preferably about 2 mm. On the other hand, the outer layer 32 has a rigidity and structural integrity sufficient to preventing breakage from occurring during the detachment (replacement) of the abrasive sheet and is made of a resinous material which is preferably the same as but harder than the inner layer 30. The preferred thickness of layer 32 is about 0.05 mm to 0.3 mm, most preferably 0.2 mm. The inner layer 30 is adhered to the bearing surface 12 of the tool body 14 by an adhesive 36 coated on the inner layer. The outer layer 32 is autogeneously bonded to the inner layer 30 by a fusion-bonding process such as a high frequency welding process, without using an adhesive. The inner layer 30 and the outer layer 32 preferably have the same profile in a plan view as the support 22 of the tool body 14.

Figure 4:
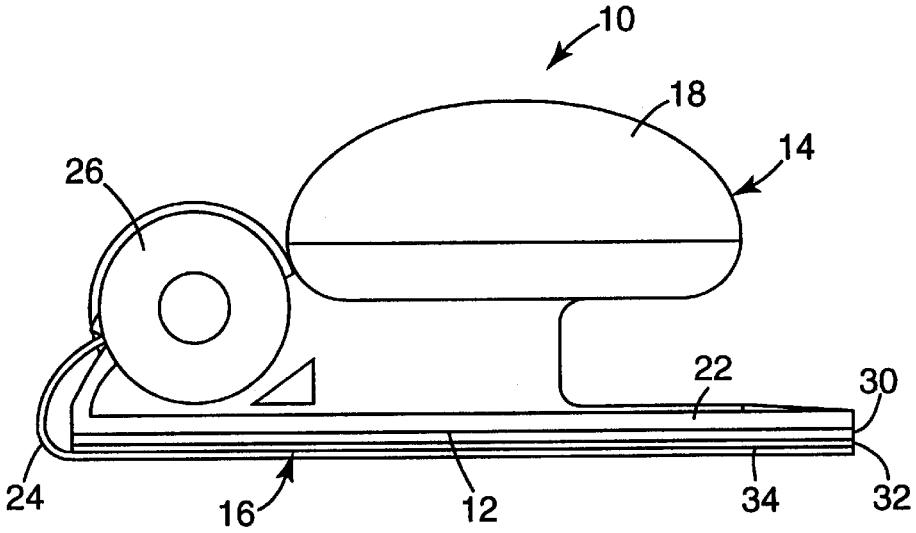
FIG. 4 is a side view of the abrasive hand tool of FIG. 1 having a strip of abrasive material deployed therein and adhered to the cushion member surface.

The adhesive-coated abrasive sheet material 24 used in abrasive hand tool 10 is well-known abrasive material wherein a pressure sensitive adhesive durable against the repeated detachments and attachments is coated on a back surface of a substrate carrying abrasive particles on a front surface thereof, and stored in a roll form of a predetermined length and width into the receptacle 26 of the tool body 14. As shown in FIG. 4, in the grinding operation, the abrasive sheet 24 is withdrawn from the receptacle 26 in a length corresponding to the dimension of the cushion member 16, which length is attached to the attachment surface 34 of the cushion member 16. If the abrasive surface of the abrasive sheet 24 has been worn by the grinding operation, the exhausted length of the abrasive sheet 24 is detached from the attachment surface 34 and cut from the roll. Then, a predetermined length of the abrasive sheet 24 is freshly withdrawn from the roll and attached again to the attachment surface 34.

As described above, according to this abrasive hand tool 10, it is possible to suitably select an abrasive sheet 24 having an abrasive surface of a desired particle size depending on the particular grinding operation including rough grinding, fine grinding or others and accommodate the same in a roll form into the receptacle 26. However, the present invention is also applicable to an abrasive hand tool of a type wherein no receptacle is provided in the tool body but an abrasive material of a cut sheet form having a predetermined length is attached to the attachment surface of the cushion member.

As previously mentioned, the abrasive sheet which can be used in the hand tool of the present invention is not limited to the above-mentioned adhesive-coated abrasive sheet, and may include an abrasive sheet, on the back surface of which one part of a two part mechanical fastener sheet material such as an interengaging fastener is provided. In this case, the attachment surface of the cushion member is provided with the other part of the two part mechanical fastener sheet material. Further, the other attachment means backed abrasive sheet may be used.

According to the abrasive hand tool 10 of the above structure, if the inner layer 30 and the outer layer 32 of the cushion member 16 is made of the same resinous material, the inner layer 30 and the outer layer 32 will equally expand even under the influence of the frictional heat transmitted to the cushion member 16 via the abrasive sheet 24 during the grinding operation, whereby the tendency for separation of the outer layer 32 from the inner layer 30 in the peripheral area thereof can be reduced or prevented. In addition, since the inner layer 30 and the outer layer 32 are bonded together by a fusion-bonding, the tendency of ply separation due to frictional heat is considerably diminished when compared to bonding these layers with a thermoplastic adhesive. In this regard, according to the fusion-bonding process, it is possible to significantly reduce a time required for bonding the inner and outer layers with each other, compared to a process using an adhesive, which results in a saving of production cost. If the inner layer 30 is made of a relatively hard material such as a polyvinyl chloride foam, it is possible to reduce or prevent a risk wherein the breakage of the interfacial adhesion area occurs between the inner layer 30 and the bearing surface 12 of the tool body under the influence of the frictional force and heat during the grinding operation and results in the detachment of the inner layer 30 from the tool body 14.

Figure 5:
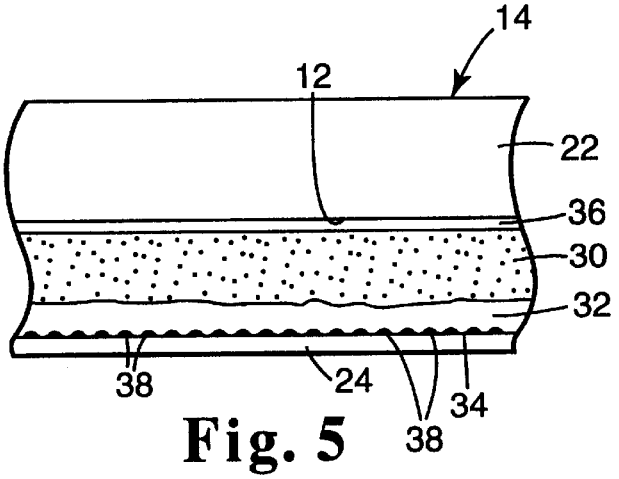
FIG. 5 is an enlarged side view of segment of an abrasive hand tool having a strip of abrasive material deployed therein and adhered to a micro-indented surface of a cushion member.

To reduce the transfer of the adhesive coated on the abrasive sheet 24 to the attachment surface 34 of the cushion member 16 under the influence of the frictional heat, as shown in FIG. 5, a plurality of micro-indentations 38 is provided on the attachment surface 34 of the outer layer 32. The micro-indentations 38 may be formed in the outer layer 32 by an embossing, perforation or by other ways to impart various surface configurations, for example, cylinder, prism, cone, straight groove or curved groove. Preferably, the micro-indentations are provided by a plurality of grooves in the outer surface 34 of layer 32 both in the length and width directions, most preferably with grooves in the same direction being parallel and equally spaced apart with a depth of about 0.02 to 0.1 mm to provide tapered square based, flat-sided, flat-topped structures separated by the grooves having a top (exposed) surface on the order of 0.3 to 0.4 mm square and a square base on the order of 0.5 mm square to provide a modified total top surface area on the order of 25 to 75% of the total top surface before grooving. The micro-indentations 38 reduce the contact area of the attachment surface 34 with the sticky surface of the abrasive sheet 24, and therefore reduce or prevent the transfer of the adhesive coated on the abrasive sheet 24 to the attachment surface 34.

EXAMPLES

The operation and effect of the hand tool according to the present invention will be more apparent by the following description of specific embodiments.

Hand tool bodies for the Examples were identical for each Example except for the cushion layer and were of the type depicted in FIG. 1 of the drawing. The cushion layers for the Example hand tools to be tested were as shown in Table 1.

Comparative Example

Comparative Example 1 had a cushion member consisting of an outer layer made of a polyvinyl chloride sheet having a Shore hardness (A) in a range between 74 and 77 fixedly secured by an adhesive to an inner layer made of a polyurethane foam having a Shore hardness (A) in a range between 15 and 20.

Example 1

Example 1 of the present invention had a cushion member wherein an outer layer made of a polyvinyl chloride sheet having a Shore hardness (A) in a range between 42 and 46 was fusion bonded to an inner layer made of a polyvinyl chloride foam having a Shore hardness (A) in a range between 20 and 22 (the fusion-bonded sheet being produced by and commercially available from Konno Gomu Co., Ltd., Shinagawa, Tokyo).

Example 2

Example 2 of the present invention had a cushion member including an outer layer made of a polyvinyl chloride sheet having a Shore hardness (A) in a range between 80 and 85 fusion bonded to an inner layer made of a polyvinyl chloride foam having a Shore hardness (A) in a range between 48 and 52 (the fusion bonded sheet being produced by and commercially available from Konno Gomu Co., Ltd.).

TESTING

The following tests were carried out on hand tools described above.

Test 1

After leaving the cushion members in an oven maintained at 60° C. for 96 hours, the change in hardness and the expansion thereof (and, in the case of the double layer structure, the expansion of the outer layer) were measured. The separation of the layers of each layered cushion member and the change in the attachment surface were also observed for each cushion member. The evaluation results are listed in Table 1.

TABLE 1

| Ex. | Cushion Member | Shore Hardness (A) Initial | Shore Hardness (A) After Heat | Expansion | Attachment Surface |
|---|---|---|---|---|---|
| Com | outer | 74 to 77 | 78 to 80 | 8.0% | separated on |
| | inner | 15 to 20 | 15 to 20 | nil | periphery |
| 1 | outer | 42 to 46 | 45 to 50 | 2.5% | no |
| | inner | 20 to 22 | 20 to 22 | nil | separation |
| 2 | outer | 80 to 85 | 80 to 85 | 0% | no |
| | inner | 48 to 52 | 48 to 52 | nil | separation |

Test 2

Adhesive-coated abrasive sheets were attached to a 14 cm long 6.4 cm wide attachment surface of each of the cushion members on a tool body and left in the oven maintained at 60° C. for 72 hours while pressing the respective abrasive sheets onto the attachment surfaces under a load of 1.5 kg applied through the tool grip 18 to provide a unit pressure of 16.7 g/cm$^2$. Thereafter, each of the abrasive sheets was detached from its attachment surface, and the degree of transfer of the adhesive to the attachment surface was observed. In this regard, the comparison was carried out in this test between a cushion member having micro-indentations on the attachment surface and one having no such micro-indentations. Results of this test are set forth in Table 2.

Test 3

The hand tools wherein the cushion members are fixedly secured to the tool bodies were left in the oven maintained at 60° C. for 48 hours. Thereafter, the tear strength of each of the cushion members (in the case of the double layer structure, the inner layers) was measured at room temperature by use of a spring balance as an index of a durability of the cushion member. Results are set forth in Table 2.

Test 4

Several identical test cushion members mounted on tool bodies, as described in Test 2, were each placed on a segment of a cylindrical rod of 10 mm diameter so that the width of the cushion member was within the rod segment ends and the rod segment was aligned parallel with the width ends of the tool and positioned below the tool grip and left in an oven maintained at 60° C. while applying a load of 1.5 kg thereto at the tool grip. One test tool was taken from the oven after 24 hours had lapsed, then the succeeding tools taken after the next 24 hours had lapsed and so on, for the purpose of observing the restoration of thickness of the cushion member after deformation of the test cushion members as an index of the cushioning function of the cushion member. The number of days elapsed until no restoration of thickness was noted as the failure point. Test results are reported in Table 2.

The test results for tests 2–4 are listed in Table 2.

TABLE 2

| | | Test 2 Transfer of adhesive | | Test 3 | Test 4 |
|---|---|---|---|---|---|
| Ex. | Cushion Member | Without Indentations | With Indentations | Tear Strength (kg) | Cushionability (days lapsed until restoration failure) |
| Com | Outer | Slight | No Actual Result | — | 4 |
| | Inner | — | — | <4.5 | — |
| 1 | Outer | Slight | None | — | 4 |
| | Inner | — | — | 6.5 | — |
| 2 | Outer | Slight | None | — | 6 |
| | Inner | — | — | 8.0 | — |

Test 1 shows that fusion bonding of the layers of the cushion layer eliminates the separation of the cushion member under the influence of heat compared with a conventional cushion layer structure. It is also apparent from Test 2 that the micro-indentations provided on the attachment surface of the cushion member which reduces or prevents the transfer of the adhesive. As for Test 3, Example 2 was the most durable cushion member. As for Test 3, Example 2 was shown to be the most cushionable cushion member.

As apparent from the above description, since the first and second layers of the cushion member in the hand tool of the present invention are bonded together by a fusion-bonding, it is possible to prevent the separation between the first and second layers caused by the influence of the frictional heat and force generated during the grinding operation. Also, the detachment of the cushion member from the bearing surface of the tool body under the influence of the frictional heat and force generated during the grinding operation is reduced or eliminated by the selection of the cushion member material. In addition, when a plurality of micro-indentations are provided on the attachment surface of the cushion member, it is possible to prevent the transfer of the adhesive coated on the abrasive sheet to the attachment surface caused by the influence of the frictional heat generated during the grinding operation. Thus, according to the present invention, a high performance abrasive hand tool is provided, capable of maintaining an excellent durability in the cushion member and a good flatness in the processed surface for a long time.

What is claimed is:

1. A hand tool having a generally flat surface secured to a cushioned laminate member adapted to hold an abrasive sheet on an attachment surface, wherein the cushioned laminate member comprises a first laminate layer of a soft material secured to the flat surface of the tool and a second laminate layer of a hard material having a Shore A hardness value at least 20 points higher than the first laminate layer and having two surfaces, a first surface fusion bonded to the first laminate layer without using an adhesive and a second surface providing the attachment surface.

2. The hand tool of claim 1 wherein the attachment surface adheres to a pressure sensitive adhesive.

3. The hand tool of claim 1 wherein the attachment surface comprises a plurality of micro-indentations.

4. The hand tool of claim 1 wherein the attachment surface is one part of a two part mechanical fastening system.

5. The hand tool of claim 1 wherein the first laminate layer has a Shore hardness value in the range of 15–52 and the second laminate layer has a shore hardness value in the range of 42–85.

6. The hand tool of claim 1 wherein the first and second laminate layers are made of polyvinyl chloride.

7. The hand tool of claim 1 wherein the hand tool contains a receptacle to hold a supply roll of the abrasive sheet.

* * * * *